United States Patent [19]

Palla, Jr.

[11] Patent Number: 4,720,904

[45] Date of Patent: Jan. 26, 1988

[54] HINGE PIN PULLER

[76] Inventor: Anthony M. Palla, Jr., 820 Honaker Dr., Charleston, W. Va. 25312

[21] Appl. No.: 907,778

[22] Filed: Sep. 16, 1986

[51] Int. Cl.[4] ..... B27B 27/02

[52] U.S. Cl. ..... 29/275; 173/90

[58] Field of Search ..... 173/90, 91; 81/44, 3.48, 81/3.47, 23; 29/254, 255, 275; 254/18, 19

[56] References Cited

U.S. PATENT DOCUMENTS

| | | | |
|---|---|---|---|
| 827,392 | 7/1906 | Prangemeier | 81/23 |
| 1,302,287 | 4/1919 | Berg . | |
| 1,381,890 | 6/1921 | Brouhard et al. . | |
| 1,747,053 | 2/1930 | Colerick | 254/19 |
| 3,036,482 | 5/1962 | Kenworthy et al. | 173/90 |
| 3,339,262 | 9/1967 | Brinson | 29/275 |
| 3,791,012 | 2/1974 | Jenkin | 29/254 |
| 4,432,125 | 2/1984 | Monteleone et al. | 29/255 |
| 4,470,440 | 9/1984 | Thor | 173/90 |
| 4,627,141 | 12/1986 | Teske | 29/275 |

*Primary Examiner*—Paul A. Bell
*Assistant Examiner*—Hien H. Phan
*Attorney, Agent, or Firm*—Fredric L. Sinder; Donald J. Singer

[57] ABSTRACT

A tool for removing hinge pins from aircraft. The tool head includes a lower member having an opening adapted for the receipt of a bent end of a hinge pin. An upper member is attached to the lower member so that it may pivot to cover and uncover the opening, thus securely locking the hinge pin in the tool head. The hinge pin rests in a groove in the lower member to properly position the pin in the tool head. The upper member is locked into position over the opening by tightening a wingnut on a threaded post against the upper member. A cutout section in the upper member provides clearance for the threaded post. The tool head may be mounted on the end of a slide hammer. The slide hammer shaft is threaded, allowing a drill chuck or other heads to be attached as the head of the slide hammer for hinge pins without bent ends.

6 Claims, 2 Drawing Figures

HINGE PIN PULLER

RIGHTS OF THE GOVERNMENT

The invention described herein may be manufactured and used by or for the Government of the United States for all governmental purposes without the payment of any royalty.

BACKGROUND OF THE INVENTION

The present invention relates generally to aircraft repair tools, and more specifically to a tool head for removing hinge pins.

Hinge pins are commonly used on aircraft to pivotably attach flight controls, landing gear surfaces and other aircraft components. Removal of the hinge pins is required for aircraft maintenance. A present method of removing hinge pins uses a pair of Vice Grips® and a hammer. The grips are locked onto a hinge pin, then struck with the hammer until the pin is removed. Although effective, this method accelerates wear, breakage and subsequent tool replacement. There is, therefore, a need for an improved tool and method for removing hinge pins.

It is, therefore, a principal object of the present invention to provide an improved tool and method for removing hinge pins.

It is another object of the present invention to reduce the chance of injury to personnel that exists in the hammer/Vice Grip® method.

It is a further object of the present invention to replace the separate hammer and Vice Grip® with a single tool.

A feature of the present invention is that the tool head is removable to allow use of other tool heads on the same handle apparatus.

An advantage of the present invention is that the removed hinge pins are not marred or damaged during removal.

SUMMARY OF THE INVENTION

The present invention is directed to a tool head comprising a lower member having an opening with an axis, an upper member movably attached to the lower member so that the upper member may cover and uncover the opening, and a threaded post that fits into a cutout notch in the upper member so that a nut on the threaded post can be tightened against the upper member to secure it in a position over the opening.

The invention additionally includes a groove in the surface of the lower member facing the upper member, the groove extending in a direction substantially perpendicular to the axis of the opening from the opening to an edge of the lower member.

The invention may be incorporated in a slide impact tool comprising a shaft, a slide on the shaft, a handle on one end of the shaft, a slide stop or abutment between the handle and slide, and a tool head according to the teachings of the present invention on the opposite end of the shaft. The tool head may be attached to the shaft by threading a threaded end of the shaft into a threaded hole in the rear of the tool head.

DESCRIPTION OF THE DRAWINGS

The present invention will be more clearly understood from a reading of the following detailed description in conjunction with the accompanying drawings wherein.

DETAILED DESCRIPTION

Figure 1:
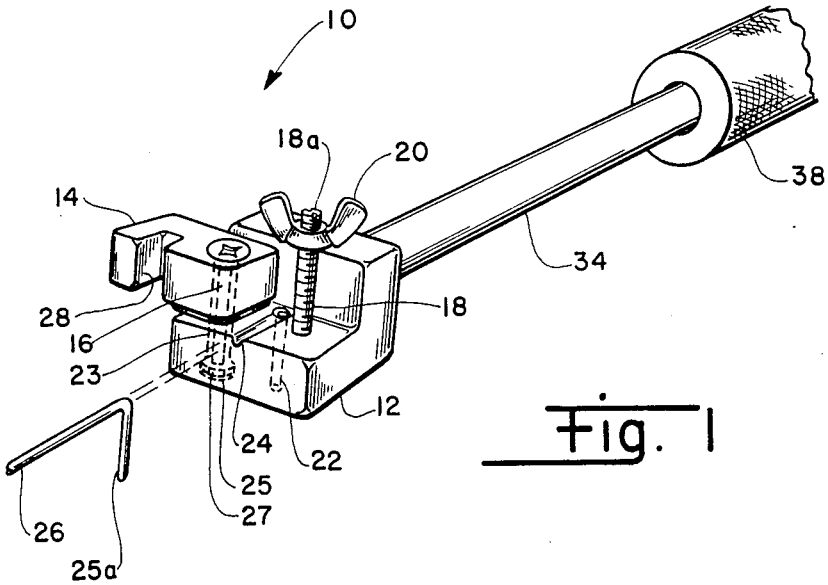
FIG. 1 is a perspective view of a tool head incorporating the teachings of the present invention showing the tool head in its open position; and, FIG. 2 is a perspective view of a slide hammer impact tool incorporating the teachings of the present invention.

Referring now to FIG. 1 of the drawings, there is shown a tool head 10 incorporating the teachings of the present invention for removing aircraft hinge pins. An aircraft hinge pin 26 typically has a diameter of about 0.082 inches. Hinge pin 26 includes a bent end **26*a*. A lower member 12 has a hole 22 and a groove 24, each sized to receive, respectively, bent end 26*a* and hinge pin 26. Lower member 12 also includes a threaded shaft 18 and a wing nut 20. Threaded shaft 18 is staked at its end 18*a* to distort the threads to prevent wing nut 20 from coming off threaded shaft 18. Lower member 12 additionaly includes a hole 23 having a countersunk section 25. Lower member 12 further includes threaded hole 30 (shown in FIG. 2). A machine screw 16 pivotably attaches an upper member 14 to lower member 12 so that upper member 14 can cover and uncover hole 22 and groove 24. A self-locking nut 27 fits inside countersunk section 25 to secure machine screw 16 in place but with sufficient clearance so that machine screw 16, lower member 12 and upper member 14 may all freely rotate in relation to each other. Upper member 14 includes a cutout section 28 to provide clearance for shaft 18 when upper member 14 is pivoted to cover hole 22. Threaded end 32 of shaft 34 attaches to tool head 10 at threaded hole 30** to provide a handle for holding the tool head.

Figure 2:
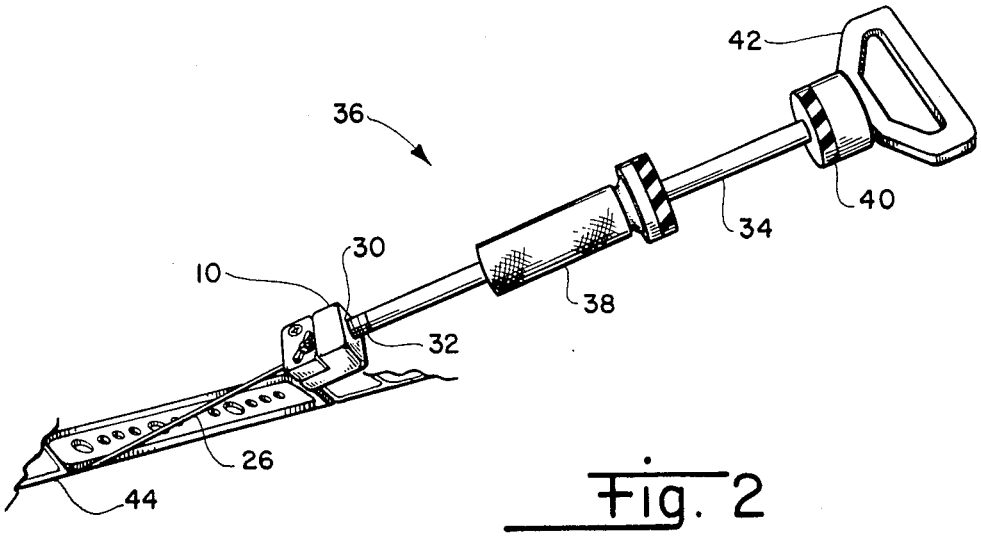

FIG. 2 shows tool head 10 incorporated a part of a slide hammer impact tool 36. Slide hammer 36 comprises primarily tool head 10, shaft 34 with threaded end 32, a slide 38, a stop or abutment 40, and a handle 42. Tool head 10 securely holds hinge pin 26 for removal from an aircraft structure 44.

To use impact tool 36, bent end **26*a* of hinge pin 26 is inserted into hole 22 and upper member 14 pivoted to cover hole 22 and secure hinge pin 26 in place. Hinge pin 26 rests in groove 24 to properly position pin 26 in tool head 10. Upper member 14 is fixed into place by tightening wing nut 20. With the secure grip on hinge pin 26 provided by head 10, hinge pin 26 generally can be removed merely by pulling handle 42. For difficult to remove hinge pins, handle 42 may be held with one hand while slide 38 is pushed forward to the head and then brought back sharply to strike stop 40. The impact of the slide will generally overcome any resistance and allow hinge pin 26 to be then easily removed. In some cases, repeated strikes of slide 38** may be necessary.

Aircraft hinge pins are normally bent at their ends as part of their normal installation. In other cases, the end of the hinge pin may be bent prior to removal. In cases where the end has broken off, or a bent end otherwise cannot be provided, a one-quarter inch drill chuck or similar apparatus can be threaded onto threaded end 32 of shaft 34 and tightened over the end of an unbent hinge pin 26.

Those with skill in the art will see that the sizes of hole 22 and groove 24 may be changed to allow for pins of different diameters. It is understood that other modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

I claim:

1. A tool head, comprising:

(a) a lower member having a surface and an opening for receipt of part of a workpiece, the opening having an axis;

(b) an upper member movably attached to the lower member so that the upper member may cover and uncover the opening;

(c) means for holding the upper member in a position covering the opening; and, (d) means defining a groove for receipt of part of the workpiece in the surface of the lower member facing the upper member, the groove extending in a direction substantially perpendicular to the axis of the opening from the opening to an edge of the lower member.

2. The tool head according to claim 1, wherein the means for holding the upper member comprises:

(a) means defining a cutout in the upper member;

(b) an upstanding threaded post defined on the lower member so that the post fits into the cutout when the the upper member is in a position covering the opening; and, (c) a nut mounted on the end of the threaded post whereby the nut, when tightened, secures the upper member in a fixed position.

3. A slide impact tool, comprising;

(a) a shaft having a first end, a second end and an axis;

(b) a slide slidably mounted on the shaft between the first end and second end;

(c) a handle defined on the second end of the shaft;

(d) a stop defined on the shaft between the handle and the slide;

(e) a head defined on the first end of the shaft, the head comprising;

(i) a lower member having a surface and an opening for receipt of part of a workpiece, the opening having an axis substantially perpendicular to a plane through the axis of the shaft;

(ii) an upper member movably attached to the lower member so that the upper member may cover and uncover the opening; and, (iii) means for holding the upper member in a position covering the opening.

4. The slide impact tool according to claim 3, wherein the means for holding the upper member comprises:

(a) means defining a cutout in the upper member;

(b) an upstanding threaded post defined on the lower member so that the post fits into the cutout when the the upper member is in a position covering the opening; and, (c) a nut mounted on the end of the threaded post whereby the nut, when tightened, secures the upper member in a fixed position.

5. The slide impact tool according to claim 3, further comprising:

(a) threads on the first end of the shaft; and, (b) means defining a threaded hole in the head, the threaded hole adapted for receipt of the threaded first end of the shaft.

6. A slide impact tool, comprising:

(a) a shaft having a first end, a second end and an axis;

(b) a slide slidably mounted on the shaft between the first end and second end;

(c) a handle defined on the second end of the shaft;

(d) a stop defined on the shaft between the handle and the slide;

(e) a head defined on the first end of the shaft, the head comprising;

(i) a lower member having a surface and an opening, the opening having an axis substantially perpendicular to a plane through the axis of the shaft;

(ii) an upper member movably attached to the lower member so that the upper member may cover and uncover the opening;

and, (iii) means for holding the upper member in a position covering the opening; and, (f) means defining a groove in the surface of the lower member facing the upper member, the groove extending in a direction substantially parallel to the axis of the shaft from the opening to an edge of the lower member.

* * * * *